US006501054B2

(12) United States Patent
Engelmann et al.

(10) Patent No.: US 6,501,054 B2
(45) Date of Patent: Dec. 31, 2002

(54) DEVICE AND METHOD FOR CONTROLLING COOKING AREAS WITH GLASS-CERAMIC COOKING SURFACES

(75) Inventors: Harry Engelmann, Ingelheim (DE); Kurt Schaupert, Hofheim (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/850,856

(22) Filed: May 8, 2001

(65) Prior Publication Data

US 2001/0052519 A1 Dec. 20, 2001

(30) Foreign Application Priority Data

May 11, 2000 (DE) ..... 100 23 179

(51) Int. Cl.[7] ..... H05B 1/02

(52) U.S. Cl. ..... 219/518; 219/705; 219/448; 219/451; 219/497

(58) Field of Search ..... 219/518, 448, 219/449, 453, 450, 497, 411–414, 626, 627, 705, 451, 452

(56) References Cited

U.S. PATENT DOCUMENTS

| | | | | |
|---|---|---|---|---|
| 4,237,368 A | | 12/1980 | Welch | |
| 4,816,647 A | | 3/1989 | Payne | |
| 5,243,172 A | * | 9/1993 | Hazan et al. | 219/450 |
| 5,658,478 A | | 8/1997 | Roeschel et al. | |
| 5,893,996 A | * | 4/1999 | Gross et al. | 219/452 |
| 6,242,721 B1 | * | 6/2001 | Borrmann et al. | 219/518 |
| 6,348,677 B2 | * | 2/2002 | Aurre et al. | 219/518 |

FOREIGN PATENT DOCUMENTS

| | | |
|---|---|---|
| AT | 238 331 | 2/1965 |
| DE | 21 39 828 | 2/1973 |
| DE | 33 27 622 A1 | 2/1985 |
| DE | 35 33 997 A1 | 3/1987 |
| DE | 37 44 372 A1 | 7/1988 |
| DE | 37 11 589 A1 | 10/1988 |
| DE | 37 33 108 C1 | 2/1989 |
| DE | 40 22 846 A1 | 1/1992 |
| DE | 196 46 826 A1 | 8/1997 |
| DE | 0 823 620 A1 | 2/1998 |
| DE | 197 00 753 A1 | 7/1998 |
| DE | 198 13 996 A1 | 10/1999 |
| EP | 0 429 120 A2 | 5/1991 |
| EP | 0 442 275 A2 | 8/1991 |
| EP | 0 469 189 A2 | 2/1992 |

* cited by examiner

*Primary Examiner*—Mark Paschall
(74) *Attorney, Agent, or Firm*—Michael J. Striker

(57) ABSTRACT

The device for controlling a cooking area on a glass-ceramic cooking surface includes an inductive cooking utensil detection device for detecting a cooking utensil on the cooking area and a temperature measurement device for measuring a temperature of the cooking surface. The cooking utensil detection device includes an outer conductor track (1) and an inner conductor track (3) nested within said outer conductor track. The temperature measurement device also includes the same outer conductor track (1) and the inner conductor track (3), so that the total number of device components is minimized. The outer conductor track (1) includes, or is supplemented by, a conductor track section (2) extending from it into a center part of the cooking area (4). The cooking utensil detection device and the temperature measurement device can operate utilizing the same outer and inner conductor tracks by time-lagged interrogation or with detection signals at different frequencies.

10 Claims, 5 Drawing Sheets

DEVICE AND METHOD FOR CONTROLLING COOKING AREAS WITH GLASS-CERAMIC COOKING SURFACES

BACKGROUND OF THE INVENTION

1. Field of the Invention

The present invention relates to a device and to a method for controlling cooking areas of a cooking unit with glass-ceramic cooking surfaces.

2. Related Art

The temperatures of the cooking areas of cooking units with glass-ceramic cooking surfaces are limited using mechanical temperature-protecting controllers. DE-A 40 22 846 and EP-A 0 823 620 disclose sensors which are mounted directly on the glass-ceramic cooking surface. They measure the temperature by via the change of the electrical resistance of a conductor track or of the glass-ceramic base material of the cooking surface in question. Monitoring the temperature directly on the glass-ceramic cooking surface is advantageous since it avoids any overheating or overloading of the glass-ceramic cooking surface and the cooking utensil, which may be standing thereon. Direct glass-ceramic temperature sensing hence provides additional safety. AT-A 238 331 discloses a cooking unit provided with a cooking area with a switching device for the power supply of its heater. The switching device enables the power supply to the heating device when the cooking utensil is put on it, and disables the energy supply when the cooking utensil is removed.

DE-A 35 33 997 and DE-A 33 27 622 disclose cooking utensil detection systems with optical detectors. Cooking utensil detection systems with inductive detectors are described in DE-A 37 11 589 and DE-A 37 33 108. Inductive proximity switches are based on the principle of damping a tuned circuit due to eddy-current losses in metals which are located in the magnetic leakage field of a multiturn sensor coil. Cooking utensil detection systems with an inductive sensor in the form of a coil are described in EP-A 0 442 275 and EP-A 0 469 189. Capacitive sensors for cooking utensil detection are disclosed by WO-A 90/107851 and EP-A 0 429 120.

DE-A 197 00 735 describes a device for inductive detection of cooking pans. The sensors consist of one single-turn coil for the transmitter and one for the receiver, which are arranged concentrically as circles in the cooking area. In this case, the coils may be formed by conductor tracks fitted on a. support plate, for example a glass-ceramic cooking plate.

The following disadvantages are encountered with the existing systems:

Two different systems, such as coils for inductive cooking utensil detection and mechanical temperature-protecting controllers, with different components are currently used for the combination of cooking utensil detection and temperature monitoring.

DE-A 196 46 826 discloses a device and method for temperature measurement and cooking utensil detection on cooking tops. This patent describes a device for measuring the temperature of a glass-ceramic cooking top and/or for detecting a cooking utensil, which is being heated on the cooking top. In this case, at least one sensor is fitted to the cooking top, in particular immediately below the cooker top. The sensor is designed as a conductor track, wherein a temperature-dependent electrical resistance is measurable between its two outer terminal ends. Two measurement terminals are branched off from the conductor-track, the two branch points delimiting a central lead section (which is remote from the outer terminal ends) of the conductor track for temperature measurement.

In a combination of cooking utensil detection according to DE-A 197 00 753 and temperature limitation according to DE-A 40 22 846 as well as EP-A 0 823 620), at least six terminals are required for each cooking area. Furthermore, the conductor tracks for the supply leads of the temperature detector need to be laid between the conductor tracks of the supply leads for the cooking utensil detection. Therefore, the supply leads for cooking utensil detection in the cold region enclose such a large area that cooking utensils placed in the cold region can cause the cooking area to be switched on, which produces a considerable safety risk.

SUMMARY OF THE INVENTION

It is an object of the present invention to provide a novel device for controlling cooking areas with glass-ceramic cooking surfaces, which involves a smaller number of components, simpler connection and safer operation, as well as an economical and safe method for controlling cooking areas with glass-ceramic cooking surfaces.

The object of the invention is achieved by a device for a controlling cooking area with a glass-ceramic cooking surface and at least one conductor track structure. The at least one conductor track structure comprises a combined device consisting of at least one inductive cooking utensil detection device and at least one temperature measurement device. The at least one temperature measurement device includes means for measuring a temperature of the glass-ceramic material or glass-ceramic surface located between at least two conductor tracks of the combined device. The at least two conductor tracks include a conductor track for temperature measurement arranged in or extending through the edge region and another conductor track arranged in or extending through the central region of the cooking area.

By virtue of this combination, the same detectors are used for cooking utensil detection and for temperature measurement, so that a simplified system involving a smaller number of components, simpler connection and safer operation is obtained according to the invention. Furthermore, it is therefore possible to arrange the terminals of the inner conductor structure for the cooking utensil detection directly next to each other, so that the enclosed area is minimized and safe operation is made possible by avoiding malfunction due to switching on the cooking area when cooking pans are put in the cold region.

The result achieved according to the invention is that the structures relevant to the cooking utensil detection are kept in the edge region of the cooking area. The maximum signal amplitude, which occurs when the inner circuit is covered by a cooking utensil that has been put on the cooking unit, can thus be tuned with the cooking utensil size matched to the cooking area size. In addition, it is possible to sense the inner region of the cooking area, which is important for temperature limitation, especially in the event of the wrong pan. Another advantage of the arrangement is that the temperature detector senses the edge region. Stressful situations, such as offset cooking utensils, which produce high temperatures in the edge region, are detected (see the draft standard DIN VDE 0700 Part 6, Annex 8). The relative sensitivity of the temperature measurement between the edge and the inner region can be adjusted by the respective conductor lengths in the individual regions and by the conductor track spacing in these regions.

The cooking surface according to the invention preferably contains a conductor track coating for measuring, monitoring and displaying the temperature which is used for automatically distributing the power, for switching off in the event of a boil dry condition and for limiting the temperature. The cooking surface also-contains a conductor track coating for automatically detecting a cooking utensil, the shape of cooking utensils and the size of cooking utensils. Surprisingly, and unexpectedly, the arrangement according to the invention is more economic for the user, increases safety during use and saves considerable energy.

In a preferred embodiment according to the invention the conductor track for the temperature measurement extending through the central region is designed as an open-ended electrode.

In another preferred embodiment according to the invention the conductor track for the temperature measurement in the central region is designed as a looped electrode.

In another particularly preferred embodiment of the invention, the leads for the inner conductor track circuit are arranged immediately next to each other. This arrangement according to the invention advantageously overcomes problems and prevents a reduction in safety from occurring when a cooking utensil is not positioned centrally on the cooking area.

A multi-circuit-heating element is provided according to the invention, wherein the innermost heating circuit is designed according to the invention. The device according to the invention is suitable for use in multi-circuit-heating elements.

An economical method for controlling cooking areas with glass-ceramic cooking surfaces having a conductor track structure according to the invention comprises providing a combined device or conductor track structure for both cooking utensil detection and temperature measurement and then performing the cooking utensil detection and temperature measurement with it.

In a preferred embodiment of the method according to the invention the temperature is measured by evaluating the temperature-dependent conductor track resistance. Good results are achieved by evaluating the temperature-dependent conductor track resistance.

In other preferred embodiments the temperature is measured by evaluating the temperature-dependent resistance of the glass-ceramic material between at least two conductor tracks. Very good results are achieved by this latter evaluation.

In further preferred embodiments of the method according to the invention the temperature is measured in the edge region and in the central region of the cooking area. The entire heating area is very advantageously sensed with this arrangement.

The temperature is measured in the central region by means of an open-ended electrode or by means of a looped electrode in preferred embodiments of the invention.

In various other preferred embodiments the signals of the cooking utensil detection device and of the temperature measurement device are separated by different frequencies for the cooking utensil detection and for the temperature measurement. In a preferred embodiment of the method according to the invention the respective signals of the cooking utensil detection device and of the temperature measurement device are separated by time-lagged interrogation.

The relative sensitivities for the temperature measurement in the outer region and the inner region are set by selecting the lengths and spacing of the conductors in preferred embodiments of the method.

The signals of the cooking utensil detection device and of the temperature measurement device, which are picked up using the same sensors, are separated by using and outputting AC voltages with different frequencies. For instance, the cooking utensil detection device is operated at from 10 MHz to 17 MHz, preferably from 11 MHz to 15 MHz, and particularly preferably from 12.5 MHz to 13.5 MHz. The temperature measurement device is operated at 150 Hz to 600 Hz, preferably from 200 Hz to 400 Hz, and particularly preferably from 250 Hz to 350 Hz.

Sequential interrogation of the two measured variables is also possible.

In the embodiment indicated, the conductor track region for the temperature measurement at the cooking area center does not contribute to the signal from the cooking utensil detection device, since the electrode extending from the outer circuit is not designed as a loop, and therefore no current flows through it. It is hence not inductively active.

In the case of two-circuit cooking areas, the additional conductor track structure at the cooking area center is derived only from the cooking utensil detection of the inner heating circuit. Using this structure, the critical inner region of a cooking pan is sensed in the case of both small and large diameters. The outer region of the large heating circuit may in this case be sensed by a separate temperature measurement by the outer cooking utensil detection structure, as is described for carrying out power redistribution in DE-A 40 22 846.35. The temperature measurement may be used for applications which are sufficiently described in the literature, such as temperature control, power redistribution, residual heat display or automated cooking. The applications are described in DE-A 21 39 828, DE-A 40 22 846 and DE-A 37 44 372, to which reference is explicitly made here.

The arrangement according to the invention has the following advantages. The same detectors are used for the cooking utensil detection and temperature measurement. The number of sensors used is halved in comparison with conventional systems. Mechanical temperature-protecting controllers are hence unnecessary. The number of terminals for inductive cooking utensil detection using conductor tracks is not increased by the additional function of temperature measurement. The supply leads to the conductor tracks for the cooking utensil detection can be laid close together and malfunctions due to putting pans in the cold region are prevented.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1:
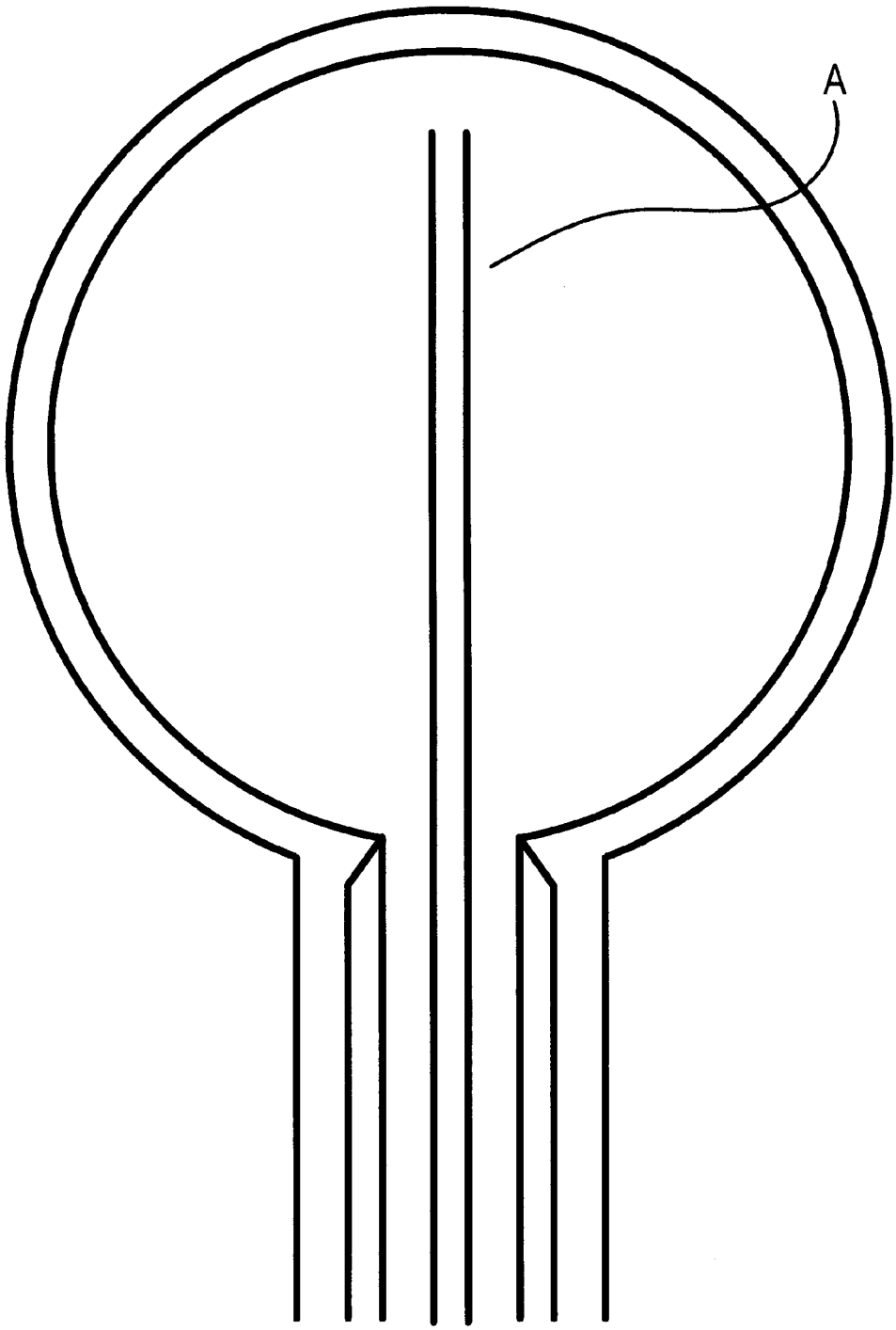
FIG. 1 PRIOR ART
FIG. 1 is a plan view of a device for controlling a cooking area with a glass-ceramic cooking surface according to the prior art.

FIG. 1 shows an embodiment of the prior art. The conductor tracks A for measuring the temperature in the central region of the cooking area by measuring of the resistance of the glass-ceramic cooking surface are arranged between the terminals of the cooking utensil detection device and the terminals of the temperature measurement device. The conductor tracks for the cooking utensil detection device enclose a large area in the cold region and the conductor tracks are embodied as one-turn coils, which can cause the cooking utensil detection device to be switched on.

Figure 2:
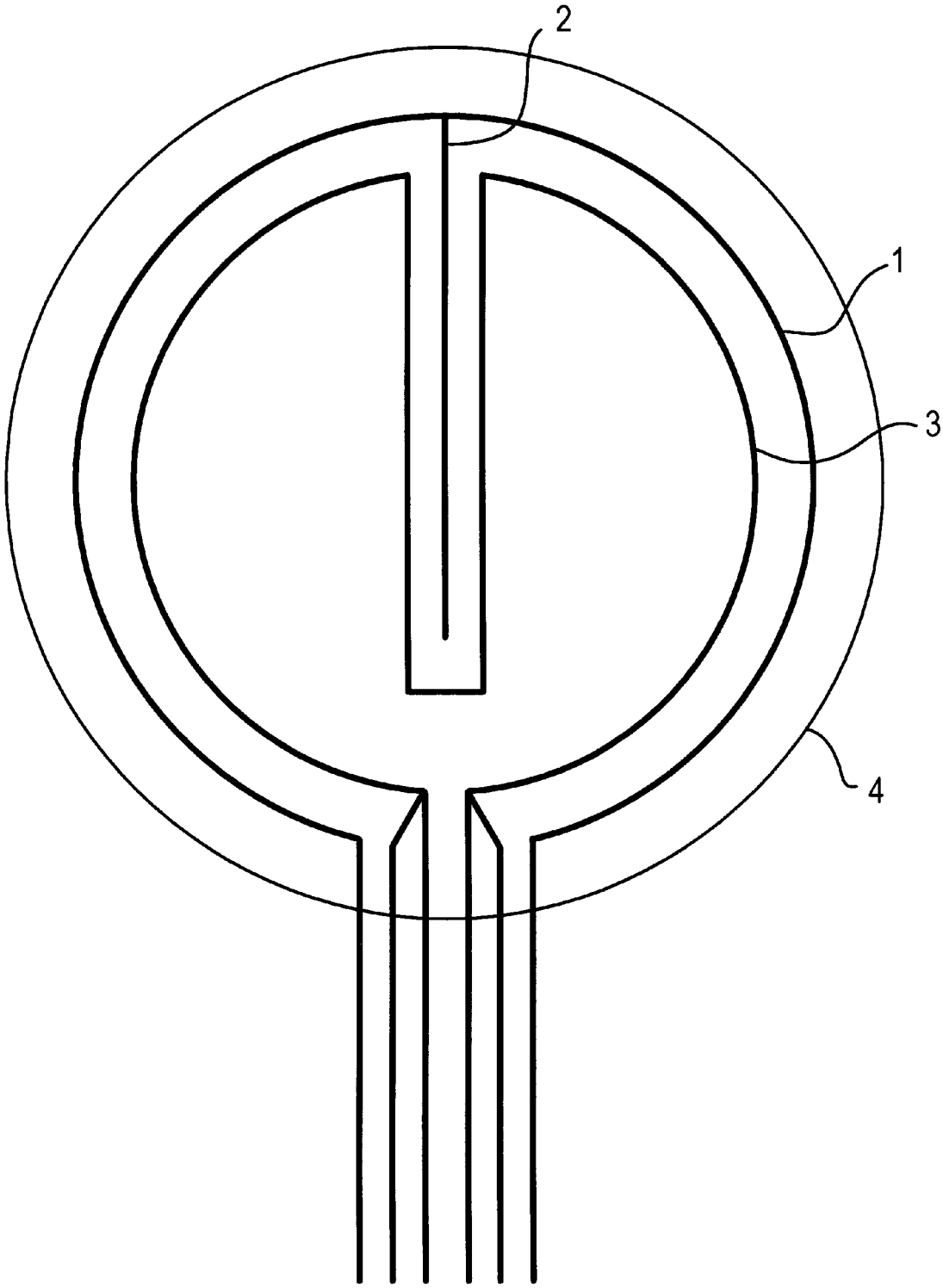
FIGS. 2 to 5 are plan views of respective embodiments of a device for a controlling cooking area with a glass-ceramic cooking surface according to the invention.

FIG. 2 shows an embodiment of the device according to the invention. In this case, the circular conductor tracks for the cooking utensil detection device and the conductor tracks leading into the middle of the cooking area for electronic temperature measurement are combined into a single device or conductor track structure. This is achieved in that the outer circuit or conductor track 1 of the cooking utensil detection device is supplemented by, or includes, a single conductor track 2 for temperature measurement, which leads into the middle and is designed as an electrode. The inner circuit 3 of the cooking utensil detection device is guided or routed around this single conductor track 2. The outer circle represents the cooking area 4.

Figure 3:
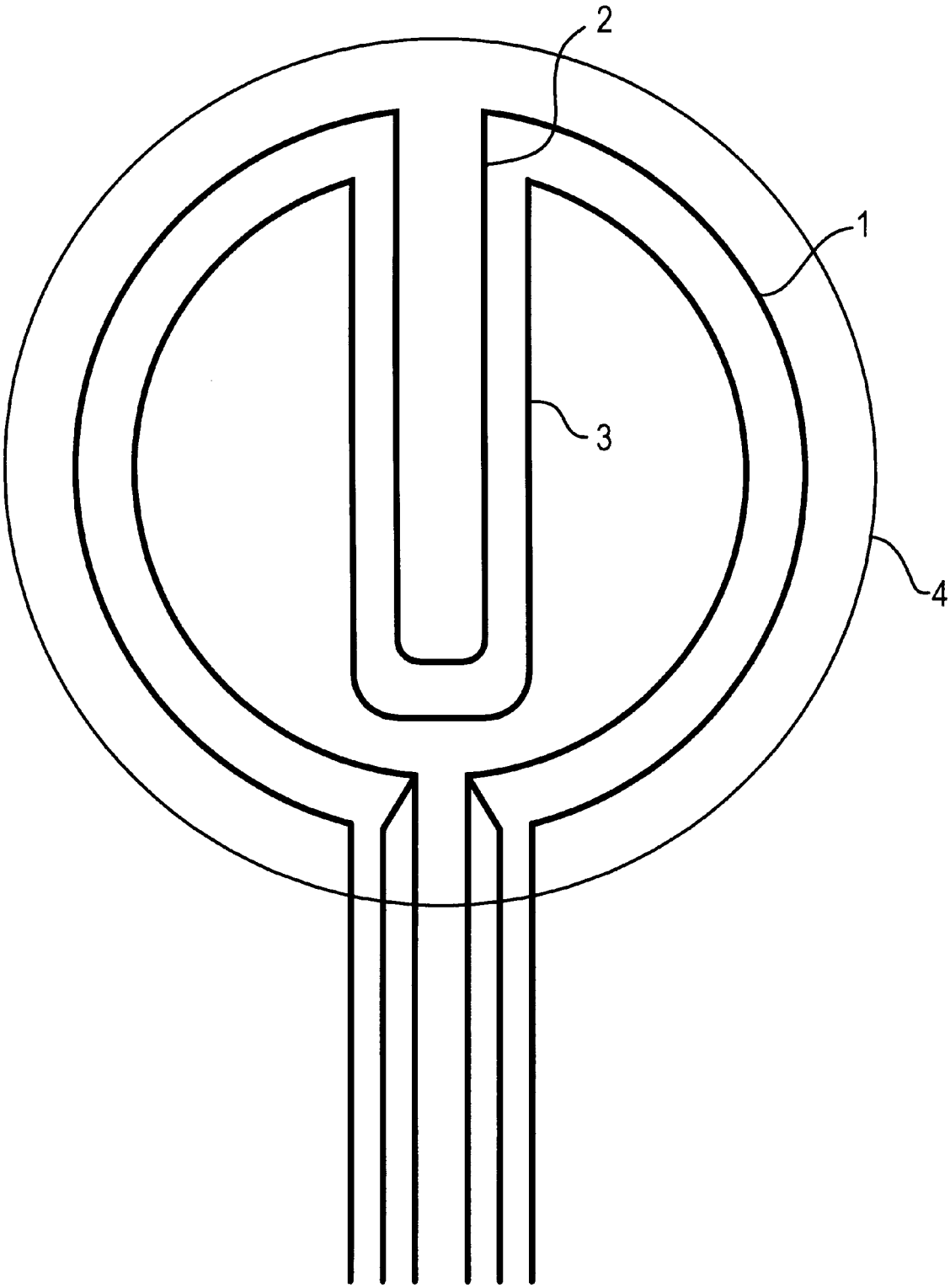

FIG. 3 shows another embodiment of the device according to the invention. In this case, the circular conductor tracks of the cooking utensil detection device and the conductor tracks leading into the middle of the cooking area for electronic temperature measurement are combined. This is achieved in that the outer circuit 1 or conductor tracks of the cooking utensil detection device is supplemented by, or includes, a conductor track 2, which leads into the middle and is designed as a loop. The inner circuit 3 of the cooking utensil detection device is arranged around this loop. The outer circle represents the cooking area 4.

Figure 4:
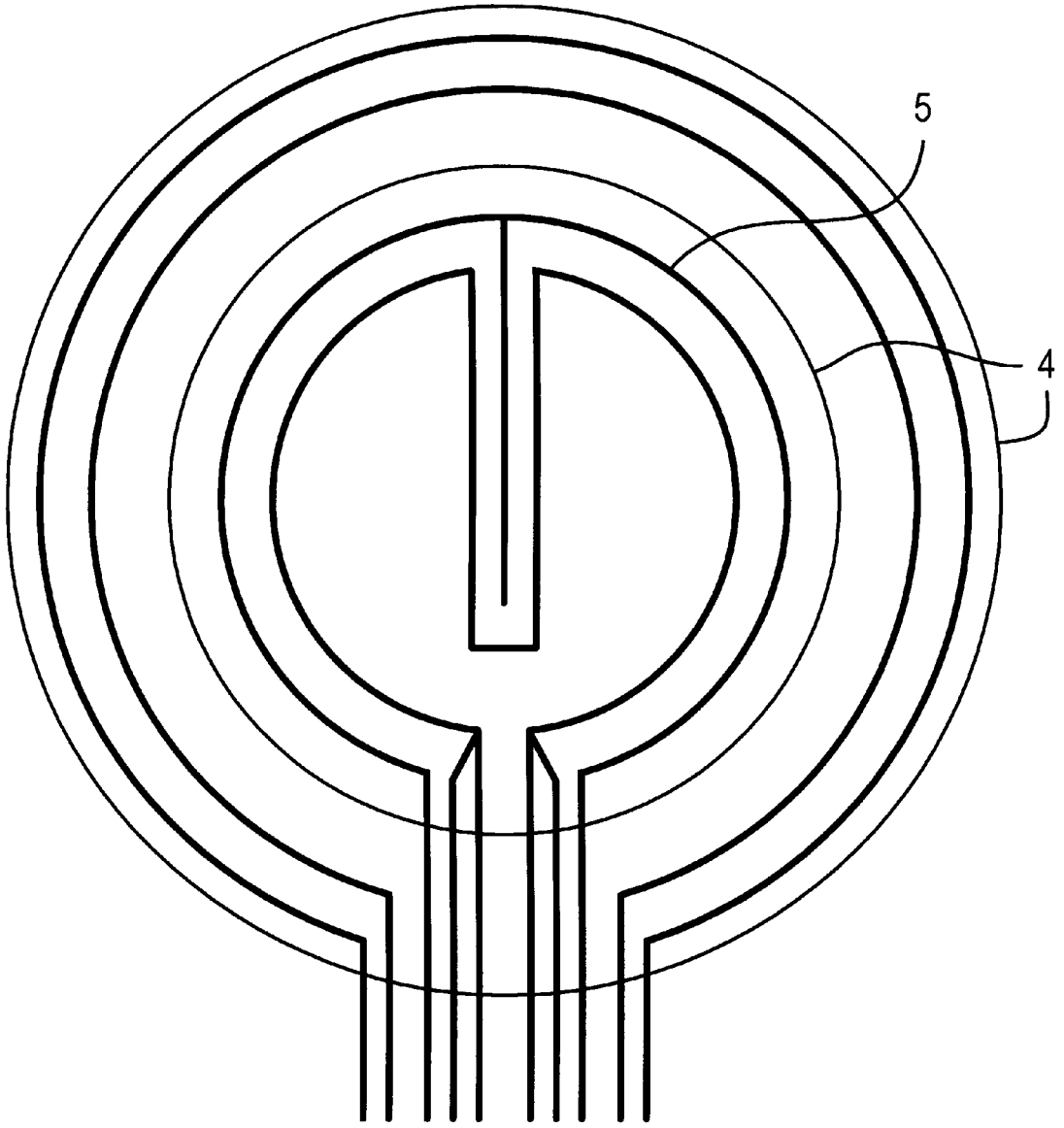

FIG. 4 shows a multi-circuit-heating element, wherein the innermost heating circuit is designed according to FIG. 2. A two-circuit cooking area 4 is represented by way of example, wherein the additional conductor track structure at the cooking area center is derived only from the cooking utensil detection device of the inner heating circuit 5. Using this structure, the critical inner region of both small and large cooking pans is sensed.

Figure 5:
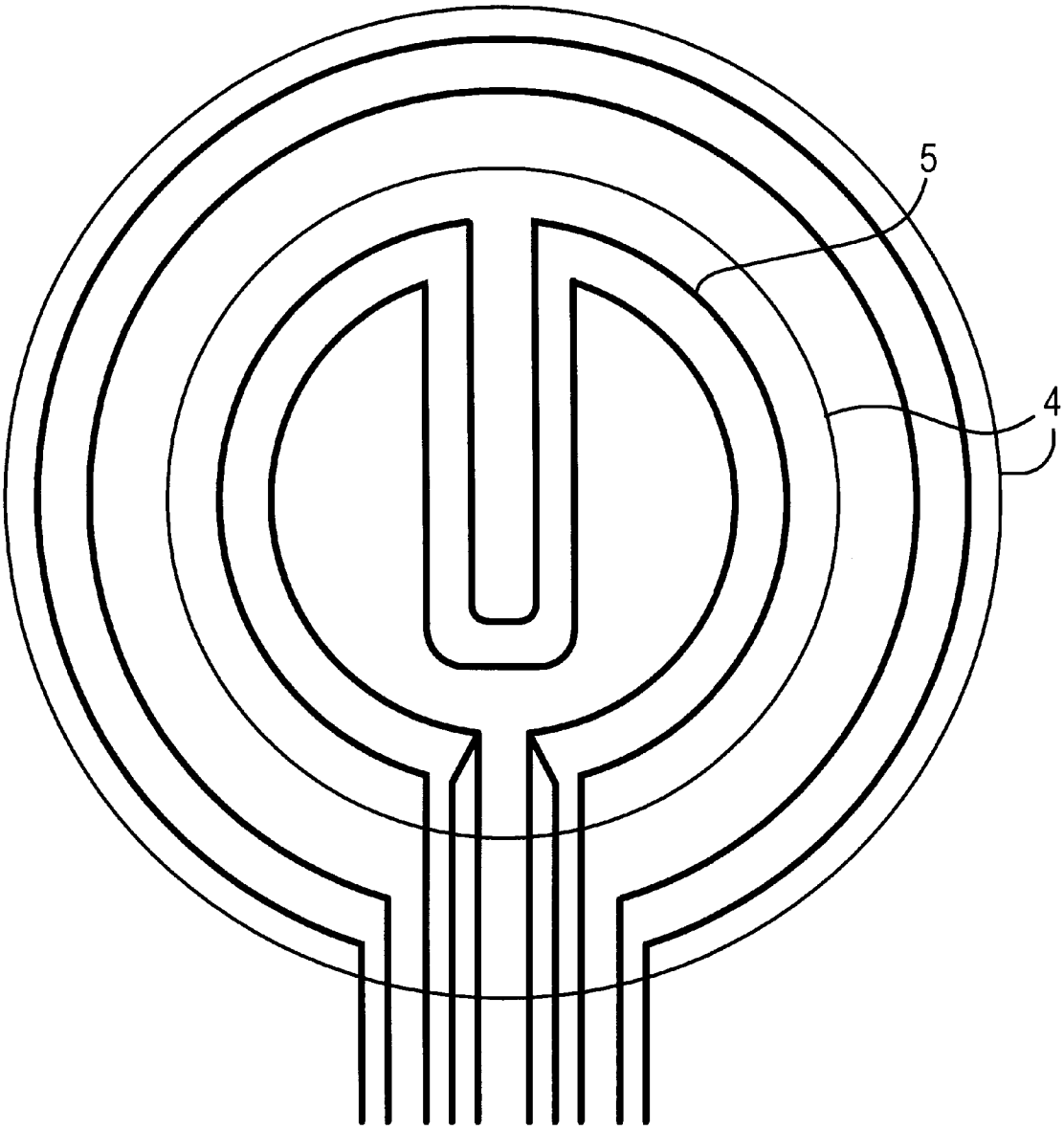

FIG. 5 shows a multi-circuit-heating element, wherein the innermost heating circuit is designed according to FIG. 3.

Comparison of the figures clearly shows that, in the case of a conductor track structure according to the prior art, as represented in FIG. 1, eight leads are required for the cooking utensil detection device and the temperature measurement device, whereas only six leads are required in the case of the conductive track structure according to the invention, as represented in FIGS. 2 and 3.

The disclosure in German Patent Application 100 23 179.9 of May 11, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a device and method for controlling cooking areas with glass-ceramic cooking surfaces, it is-not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A device for controlling a cooking area (4) on a glass-ceramic cooking surface, said device comprising at least one inductive cooking utensil detection device for detecting the presence of a cooking utensil placed on the cooking area and at least one temperature measurement device for measuring a temperature of the glass-ceramic cooking surface in the cooking area;

wherein said at least one inductive cooking utensil detection device includes an outer conductor track (1) and an inner conductor track (3), said inner conductor track (3) being nested within said outer conductor track, and said outer conductor track (1) and said inner conductor track (3) are arranged in the glass-ceramic cooking surface within the cooking area; and wherein said at least one temperature measurement device comprises said outer conductor track (1) and said inner conductor track (3) of said at least one inductive cooking utensil device, and said outer conductor track (1) includes a conductor track section (2) extending from said outer conductor track (1) into a center part of said cooking area (4), whereby said at least one inductive cooking utensil detection device and said at least one temperature measurement device share said inner conductor (3) and said outer conductor track (1) so as to minimize a total number of device components.

2. The device as defined in claim 1, wherein said conductor track section (2) is an electrode loop having a loop end portion in said center part of said cooking area.

3. The device as defined in claim 1, wherein said conductor track section (2) is an open-ended electrode strip.

4. The device as defined in claim 1, wherein said inner conductor (3) and said outer conductor track (1) each have a respective circular section, said conductor track section (2) of said outer conductor track extends from said circular section of said outer conductor track (1 ) into said center part and a portion of the inner conductor track is guided around said conductor track section (2) of the outer conductor track.

5. A method of controlling a cooking area with a glass-ceramic cooking surface, said method comprising:

a) providing a device comprising at least one inductive cooking utensil detection device for detecting the presence of a cooking utensil placed on the cooking area and at least one temperature measurement device for measuring a temperature of the glass-ceramic cooking surface in the cooking area; said at least one inductive cooking utensil detection device including an outer conductor track (1) and an inner conductor track (3), said inner conductor track (3) being nested within said outer conductor track, and said outer conductor track (1) and said inner conductor track (3) being arranged in the glass-ceramic cooking surface within the cooking area; and wherein said at least one temperature measurement device comprises said outer conductor track (1) and said inner conductor track (3) of said at least one inductive cooking utensil device, and said outer conductor track (1) includes a conductor track section (2) extending from said outer conductor track (1) into a center part of said cooking area (4);

b) detecting the presence or absence of a cooking utensil in the cooking area inductively by means of said at least one cooking utensil detection device; and c) measuring the temperature of the glass-ceramic cooking surface by measuring a temperature-dependent resistance of the glass-ceramic cooking surface by means of said at least one temperature measurement device.

6. The method as defined in claim 5, further comprising additionally measuring said temperature by evaluating a temperature-dependent conductor track resistance.

7. The method as defined in claim 5, wherein said temperature of the glass-ceramic cooking surface is measured in an edge region and in a central region of the glass-ceramic cooking surface.

8. The method as defined in claim 5, wherein said at least one inductive cooking utensil detection device and said at least one temperature measurement device generate respective signals for cooking utensil detection and for temperature measurement at correspondingly different frequencies.

9. The method as defined in claim 5, further comprising time-lagged interrogation of said at least one inductive cooking utensil detection device and said at least one temperature measurement device for cooking utensil detection and for temperature measurement.

10. The method as defined in claim 5, further comprising setting relative sensitivities for temperature measurement in an inner region and an outer region of said cooking area by selection of respective lengths and spacing of said conductors.

* * * * *